US005090565A

United States Patent [19]

Wang

[11] Patent Number: 5,090,565

[45] Date of Patent: Feb. 25, 1992

[54] ADHESIVE TAPE HOLDER

[75] Inventor: Chung-Ching Wang, Taipei, Taiwan

[73] Assignee: Seal King Industrial Co., Ltd., Taiepi, Taiwan

[21] Appl. No.: 638,815

[22] Filed: Jan. 8, 1991

[51] Int. Cl.[5] ..... B65D 85/671

[52] U.S. Cl. ..... 206/411; 225/106

[58] Field of Search ..... 206/389, 408, 411; 225/103, 106

[56] References Cited

U.S. PATENT DOCUMENTS

| | | | |
|---|---|---|---|
| 1,829,577 | 10/1931 | Anderson | 206/411 |
| 1,880,950 | 10/1952 | Ewing | 206/411 |
| 3,403,869 | 10/1968 | Marchisen | 206/408 |
| 3,725,182 | 4/1973 | Regan | 206/408 |
| 4,651,910 | 3/1987 | Degroot | 206/411 |

FOREIGN PATENT DOCUMENTS

| | | | |
|---|---|---|---|
| 0606396 | 8/1948 | United Kingdom | 206/411 |

*Primary Examiner*—Jimmy G. Foster

*Attorney, Agent, or Firm*—Fleit, Jacobson, Cohn, Price, Holman & Stern

[57] ABSTRACT

An adhesive tape holder having a base and a roller plate is disclosed. An urging member having an urging plate is formed at one end of a notch formed on the roller plate. A pressing plate is disposed on the slot formed at the other end on the notch. The urging plate is in contact with the adhesive tape such that the rotation of hte adhesive tape roll mounted onto a roller will pull it the tape and cut out at a desired length.

2 Claims, 3 Drawing Sheets

ADHESIVE TAPE HOLDER

BACKGROUND OF THE INVENTION

The present invention relates to an adhesive tape holder, in particular, to a holder for the adaptation of adhesive tape rolls which provide convenient tearing of the tape.

In a conventional type of adhesive tape holder, there is a rotary adhesive tape holder for an adhesive tape roll rotated by a pressing element. The end section of the roll is pressed against a blade portion of the holder which facilitates the tearing of the tape. In fact such an adhesive tape holder provides a convenient tearing of a section of the tape, but the structure for such a holder is rather complicated and the cost of manufacturing is high. Besides, the rotation of the tape roll is only in one direction, if the pressing element is accidentally pressed, an excessive length of tape is withdrawn and it cannot be returned to the original adhesive tape roll. As a result, this section of the tape has to be torn away form the roll and causes a waste of the tape. In addition, when a new roll of tape is to be installed, within the housing, screws must be loosened to remove the cover of the housing.

It is an object of the present invention to provide an adhesive tape holder which has a simple structure and is economic in manufacturing.

If is an object of the present invention to provide an adhesive tape holder which provides a convenient tearing of a section of tape.

It is a further object of the present invention to provide an adhesive tape holder which facilitates mounting of tape roll within the housing without the loosening of the cover.

It is yet another object of the present invention to provide an adhesive tape holder which will not withdrawn excessive length of the tape roll.

It is yet another object of the present invention to provide an adhesive tape holder wherein any excessive length of tape can be restored to the tape roll.

BRIEF DESCRIPTION OF THE DRAWINGS

Other features and advantages of the present invention will become apparent from the following description taken in connection with the accompanying drawing wherein.

DETAILED DESCRIPTION OF THE PREFERRED EMBODIMENT

Figure 1:
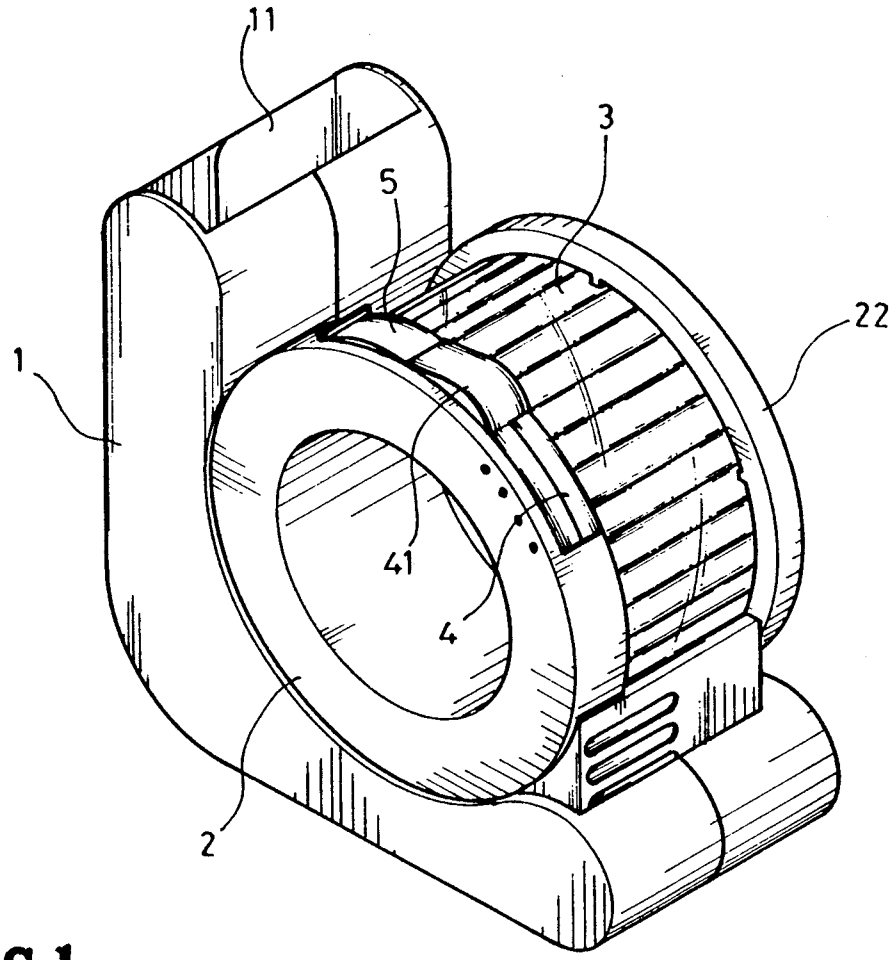
FIG. 1 is a perspective view of the adhesive tape holder in accordance with the present invention.
Figure 2:
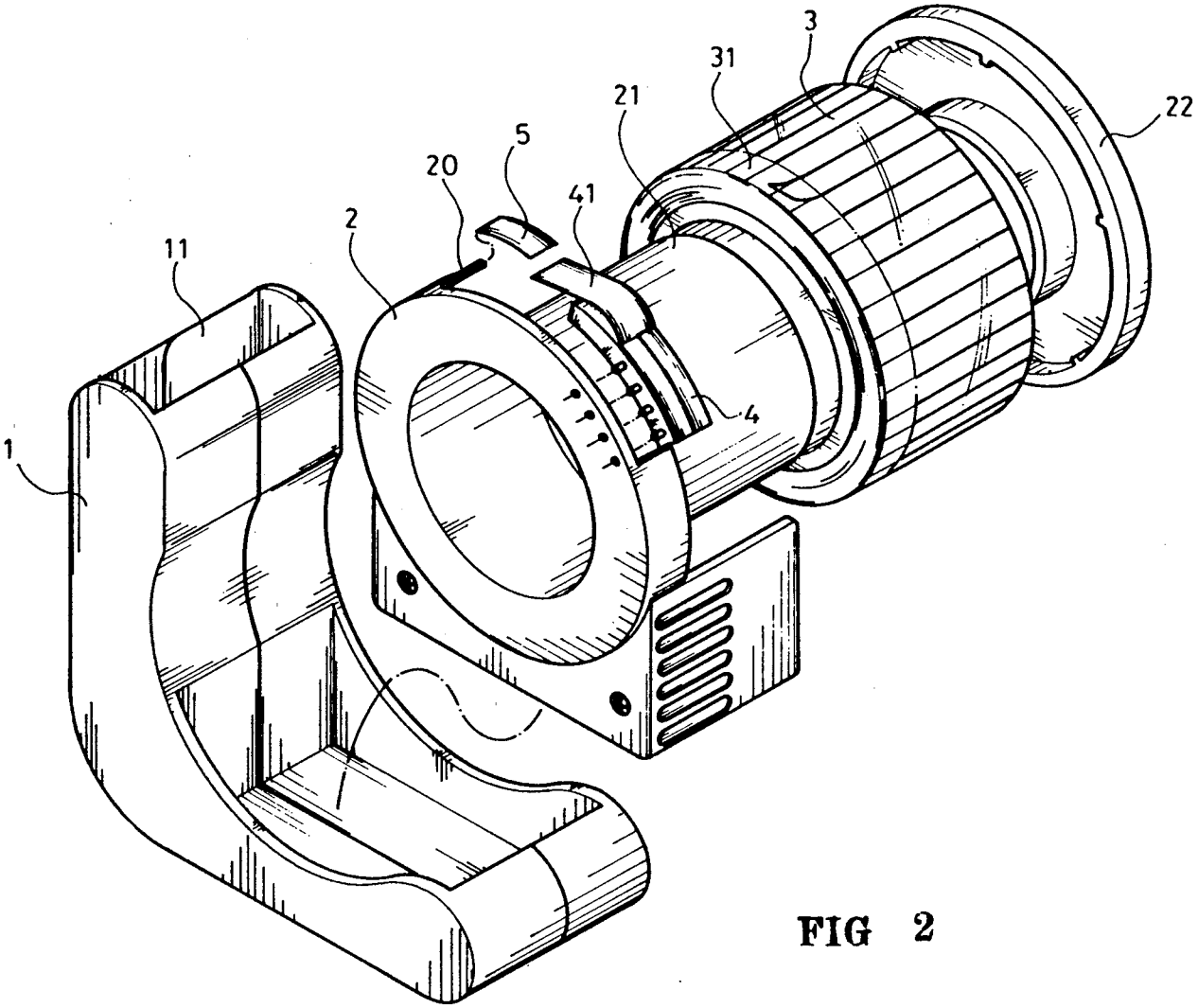
FIG. 2 is a perspective exploded view of the adhesive tape holder in accordance with the present invention.
Figure 3:
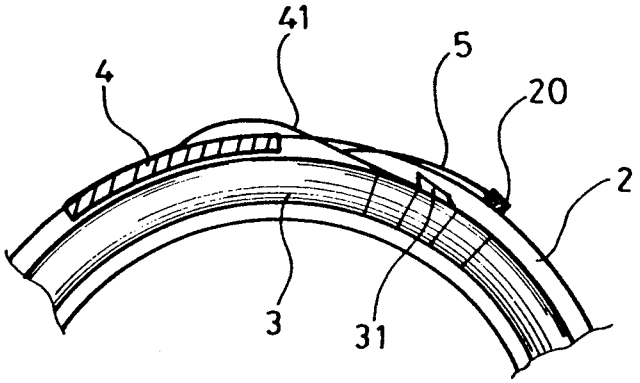
FIG. 3 is a partial sectional view; illustrating the pressing plate and urging plate with respect to the tape in accordance with the present invention.

Referring now to FIGS. 1 and an adhesive tape holder can be seen. The holder essentially comprises a base plate 1 and a roller plate 2, wherein a notch is provided on the roller plate 2. The roller plate 2 is substantially circular. At one edge of the notch, an urging member 4 having an urging plate 41 are provided. The urging plate 41 is curved downward at one end. The other end thereof is mounted to the urging member 4 such that the urging plate 41 can be in contact with the upper surface of the adhesive tape roll 3 which is mounted on the roller 21. The upper surface of the adhesive tape 3 is without adhesive agent. During the rotating of the tape roll 3, the unadhesive portion 31 of the tape is pulled up and facilitates tearing of tape with the hands of the user. At the other end of the notch, a slot 20 is provided for the adaptation of a pressing plate 5. The end portion of the pressing plate 5 presses the upper portion of the urging plate 41 to provide downward spring force of the urging plate 41, such that the urging plate 41 remains constantly in contact with the adhesive tape.

In addition, the adhesive tape roll 3 is inserted onto the roller 21 such that a circular lateral cap 22 can be used to cover the center hollow portion of the roller 21 and thus prevent falling out of the adhesive tape roll. Such a combination of cap 22 with the adhesive roll 3 forms a complete structure for a roller plate 2. The complete structure can be fitted into the cavity of the base plate 1, the base plate 1 is substantially an L-shaped structure of which the top portion is provided with a hollow container 11 and the horizontal portion is provided with a rectangular cavity which is used to keep small stationary items such as pencils, rulers, etc.

While the invention has been particularly shown and described with reference to a preferred embodiment it will be, of course, understood by those skilled in the art that the above modification and various other changes in form and detail may be made without departing from the spirit and scope of the invention.

What is claimed is:

1. An adhesive tape holder for a tape roll comprising:

a base plate being substantially L-shaped having a rectangular cavity in a horizontal portion thereof, a roller plate connected to a roller for receiving said adhesive tape roll; the outer edge of the roller plate being provided with a notch having an engaging slot at one end, the roller plate being mounted within the rectangular cavity of the base plate, an urging member mounted at one end of the notch, the urging member having an upper end provided with a downward curved elastic urging plate;

a pressing plate mounted at an opposite end of the notch and having one end thereof pressed against the urging plate; and a lateral cap on the roller to prevent falling off of the tape roll.

2. An adhesive tape holder as claimed in claim 1, wherein the base plate has a storage compartment in a vertical portion thereof.

* * * * *